US011542645B2

(12) United States Patent
Jackson et al.

(10) Patent No.: US 11,542,645 B2
(45) Date of Patent: Jan. 3, 2023

(54) DEVICES AND RELATED METHODS FOR MAINTAINING WOVEN MATERIAL IN FIXED ORIENTATION

(71) Applicants: Jannette Lee Jackson, Nokesville, VA (US); Cecil Roger Jackson, Nokesville, VA (US)

(72) Inventors: Jannette Lee Jackson, Nokesville, VA (US); Cecil Roger Jackson, Nokesville, VA (US)

( * ) Notice: Subject to any disclaimer, the term of this patent is extended or adjusted under 35 U.S.C. 154(b) by 95 days.

(21) Appl. No.: 16/926,759

(22) Filed: Jul. 12, 2020

(65) Prior Publication Data

US 2021/0025092 A1 Jan. 28, 2021

Related U.S. Application Data

(60) Provisional application No. 62/879,492, filed on Jul. 28, 2019.

(51) Int. Cl.
*D05B 11/00* (2006.01)
*D05B 39/00* (2006.01)

(52) U.S. Cl.
CPC ..... *D05B 11/00* (2013.01); *D05B 39/005* (2013.01)

(58) Field of Classification Search
CPC ..... D05B 39/005; D05B 11/00
See application file for complete search history.

(56) References Cited

U.S. PATENT DOCUMENTS

| | | | | | |
|---|---|---|---|---|---|
| 383,533 | A * | 5/1888 | NaLUDWIG | D05C 1/02 | 38/102.21 |
| 1,022,295 | A * | 4/1912 | Bowman | A47G 25/481 | 223/96 |
| 1,299,873 | A * | 4/1919 | Trueb | D06C 3/00 | 38/102.4 |
| 2,792,979 | A * | 5/1957 | Cole | A47G 25/485 | 223/96 |
| 3,056,533 | A * | 10/1962 | Snyder | A47G 25/481 | 223/96 |
| 3,865,287 | A * | 2/1975 | Peterson | A47G 25/481 | 223/96 |
| 4,027,812 | A * | 6/1977 | Roseberg | A47G 25/481 | 223/96 |
| 4,893,423 | A * | 1/1990 | Heinrich | D05C 1/02 | 226/91 |
| 2012/0248158 | A1* | 10/2012 | De Clerck | A47G 25/26 | 223/85 |
| 2014/0190047 | A1* | 7/2014 | McCoy | D05B 11/00 | 38/102.91 |

* cited by examiner

*Primary Examiner* — Nathan E Durham
(74) *Attorney, Agent, or Firm* — Capitol Patent and Trademark Law Firm, PLLC

(57) ABSTRACT

Devices and related methods for, among other things, maintaining the warp/weft threads of a backing layer of material (e.g., fabric) in a fixed orientation while being sewed are described and provided.

19 Claims, 15 Drawing Sheets

DEVICES AND RELATED METHODS FOR MAINTAINING WOVEN MATERIAL IN FIXED ORIENTATION

RELATED APPLICATION

The present application claims priority to U.S. Provisional Application No. 62/879,492 filed Jul. 28, 2019. (the "'492 Application"). The present application incorporates by reference the entirety of the disclosure of the '492 Application as if the '492 Application were set forth in full herein.

INTRODUCTION

This section introduces aspects that may be helpful to facilitate a better understanding of the described invention (s). Accordingly, the statements in this section are to be read in this light and are not to be understood as admissions about what is, or what is not, in the prior art.

When using a sewing machine to create a quilt (either a hand-directed sewing machine or a computer-controlled sewing machine), it is important for the layer of fabric that is used as the underside of the quilt (that layer referred to hereinafter as the "backing" layer or "backing" for short) to retain its "as woven" orientation as much as possible. Thus, the backing layer may be referred to as a "foundation" layer upon which the remaining layers are placed. If the backing is subjected to uneven tension along its selvage edges, the warp threads of the backing will skew with respect to the weft threads of the backing, distorting the fabric of the backing layer (hereafter "distortion"). If such a distorted backing layer is thereafter attached to the remaining layers forming the quilt (i.e., the top layer and a "batting" material layer, the latter positioned between the top layer and the backing layer) the finished, quilted product that includes all three layers will also exhibit this distortion because the distorted backing layer has now been permanently stitched into place affecting the other two layers.

Typically, during the manufacture or construction of a finished, quilted product the top and batting layers are held within a mechanical device called a roller. The backing layer is also held by a roller. Typically the backing roller is parallel to, but separate from, the roller holding the other two layers. To make a finished quilted product it is necessary for the rollers to feed or otherwise move their respective layers such that the backing layer is directly underneath the top and batting layers as a sewing machine is moved over the three layers, for example. Accordingly, as described previously, it is important to remove or minimize any distortion in the backing layer. Presently, in such a process each of the rollers holds top ("head") and bottom ("foot") edges of its respective layers However, the side edges, referred to as "selvage edges" or "selvage sides", remain unsupported and are, therefore, subject to distortion.

While methods of preventing or minimizing the distortion of the backing layer have been attempted, none have proved acceptable because distortion of the orientation of the warp and weft threads still occurs, or such methods narrows the fabric of one or more of the layers, and/or are very difficult and slow.

Yet another method pulls the selvage sides outward in an attempt to stabilize the backing layer and the orientation of the individual threads. FIG. 1 illustrates an existing technique, where a set of four clamps 1A, 1B, 1C and 1D are positioned on opposed edges of a backing layer with each clamp attached to a tensioning strap (e.g., strap 2 attached to clamp 1D). By tightening each strap the side edges of the backing layer may no longer droop (i.e., distort). However, many times the straps will apply uneven forces to their respective clamps which results in the introduction of undesirable distortion to the backing layer. The use of such multiple, individual clamps on each selvage edge has also been found to introduce a type of undesirable, "scalloping" distortion, because the piece of the backing layer actually held within each clamp 1A, 1B, 1C and 1D (i.e., the fabric in contact with elements of each clamp) receives a different amount and type of force than the backing layer sections outside of the clamps. For example, the piece of the backing layer fabric actually held within each clamp 1A, 1B, 1C and 1D may receive a higher amount of force than the section of backing layer (e.g., fabric) between clamp 1A and 1B.

Accordingly, it is desirable to provide devices and related methods that overcome the shortfalls of existing techniques. More particularly, to provide devices and related methods that reduce or minimize (collectively "reduce") the amount of distortion in finished, quilted products.

SUMMARY

The inventors disclose various systems, devices and related methods that may be used to reduce the amount of distortion in a finished, quilted product.

In one embodiment of the invention, an inventive device for reducing the distortion of a quilted product may comprise: a first lengthwise component; a second lengthwise component; one or more hinges for: (i) hingably connecting the lengthwise components, (ii) allowing the lengthwise components to hingably move and (iii) controlling or fixing a spatial relationship between the lengthwise components; and a lever securely connected to the first lengthwise component by a first transverse pin and comprising a lower section securely connected to the second lengthwise component by a second transverse pin, the lever operable to move the first component towards the second component to fix in position an edge portion of a backing layer within the first and second lengthwise components and move the first component away from the second component to release the edge portion of the backing layer from within the first and second lengthwise components.

It should be understood that the one or more hinges may comprise a single long, continuous hinge, while the first and second components may each comprise one or more shaped, relief corner edge surfaces (e.g., a diagonal surface) configured substantially proximate to one of the hinges for reducing binding of the backing layer.

In an embodiment the first and second lengthwise components may compose an aluminum (e.g., lightweight aluminum) or, alternatively, a lightweight plastic.

The device may further comprise a gripping layer positioned on, or made integral to, inside, outer edges of each the first and second lengthwise components for contacting the edge portion of the backing layer fixed in position between the first and second lengthwise components to further fix in position the edge portion between the components. On exemplary composition of a gripping layer is a non-skid foam (e.g., a closed cell, ethylene propylene diene monomer material with a high coefficient of friction surface).

An exemplary, non-limiting weight of the device may be 7 ounces or less while an exemplary, non-limiting length of the first component may be dependent upon a usable throat distance and the length of the second component is separately dependent upon the usable throat distance, where "separately" means that each component need not have the same dimension. Yet further, an exemplary, non-limiting width of the first component may be 2 inches and an exemplary, non-limiting width of the second lengthwise component may be separately 2 inches.

It should be understood that the width of the first and second lengthwise components should be wide enough to cover a portion of a backing layer without the need to precisely position an edge portion of the backing layer between the lengthwise components.

In an embodiment, each of the lengthwise components may comprise a substantially flat, lengthwise section and a substantially right angle, bend section for providing rigidity and strength to a respective component and for reducing bowing of a respective component. Optionally, at least each of the first and second lengthwise components may comprise one or more coatings for reducing the transfer of oxidants to a quilted product, where the one or more coatings may be selected from a powder, paint, or plating, for example. Alternatively, the one or more coatings for each lengthwise component may be integral to a respective lengthwise component (e.g., when the component is composed of a plastic).

The exemplary device may further comprise (i) a bracket connected to substantially a center of the second lengthwise component for distributing forces applied to the device by tensioning means for applying a substantially uniform force along the entire length of the edge portion ("tensioning means"), and (ii) such tensioning means (e.g., an elastic portion and a substantially non-elastic portion).

An exemplary lever included in the exemplary device may comprise, for example, edge surfaces configured to slidably move against the first transverse pin as force is applied to the lever, wherein the first and second transverse pins and edge surfaces slidably guide movement of the first lengthwise component with respect to the second lengthwise component.

In addition to the devices described above the invention also provides corresponding and associated methods for reducing the amount of distortion in a finished, quilted product.

DETAILED DESCRIPTION, WITH EXAMPLES

Figure 1:
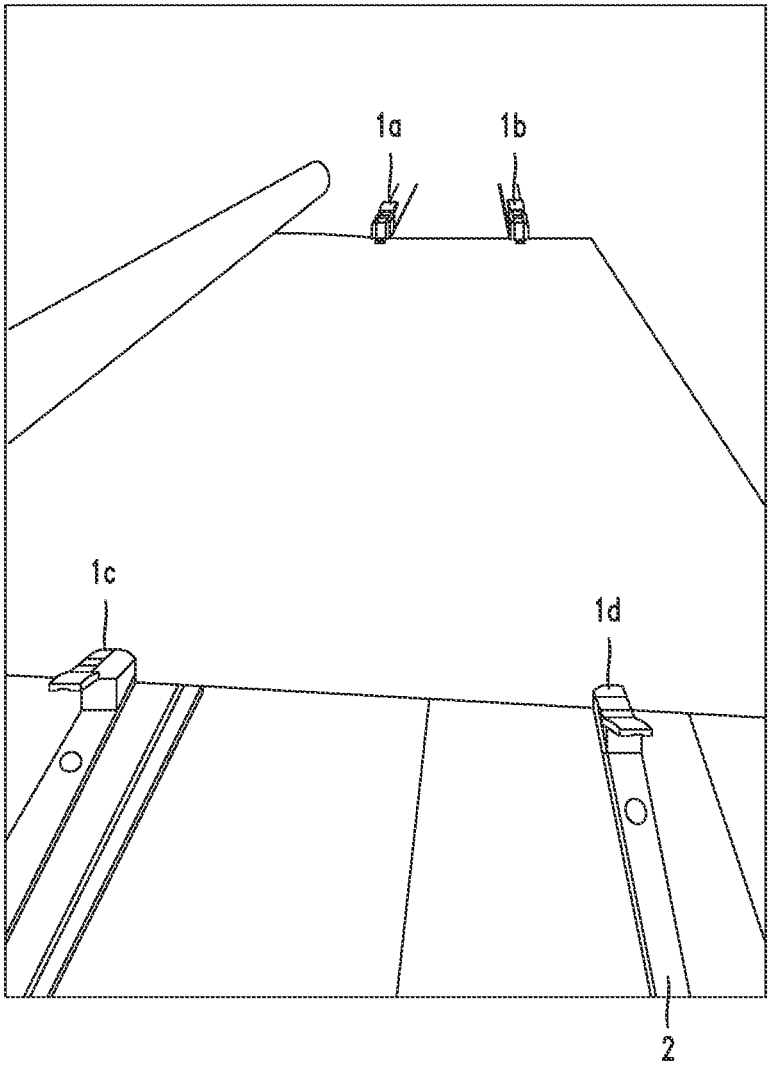
FIG. 1 (PRIOR ART)
FIG. 1 depicts an illustration of an existing technique for holding fabric.

Exemplary embodiments of devices and related methods for reducing distortion in finished, quilted products by, for example, maintaining woven fabric in respective, fixed orientations are described herein and are shown by way of example in the drawings. Throughout the following description and drawings, like reference numbers/characters refer to like elements or components.

It should be understood that although specific embodiments are discussed herein, the scope of the present disclosure is not limited to such embodiments. On the contrary, it should be understood that the embodiments discussed herein are for illustrative purposes, and that modified and alternative embodiments that otherwise fall within the scope of the disclosure are contemplated because it is impractical to describe herein with any degree of clarity each and every variation of the inventive ideas for reducing distortion of finished, quilted products. For example, though the inventive devices and methods may be applicable to fix a backing layer, such devices and methods may be applicable to fix a plurality of layers of different material.

It should also be noted that one or more exemplary embodiments may be described as a process or method (the words "method" or "methodology" may be used interchangeably with the word "process" herein). Although a process/method may be described as sequential, it should be understood that such a process/method may be performed in parallel, concurrently or simultaneously. In addition, the order of each step within a process/method may be rearranged. A process/method may be terminated when completed, and may also include additional steps not included in a description of the process/method if, for example, such steps are known by those skilled in the art.

As used herein, the term "and/or" includes any and all combinations of one or more of the associated listed items. As used herein, the singular forms "a," "an" and "the" are intended to include the plural form, unless the context and/or common sense or knowledge of one skilled in the art indicates otherwise.

It should be understood that when an system or device, or a component or element of a system or device, is referred to, or shown in a figure, as being "connected" to (or other tenses of connected) another system, device (or component or element of a system or device) such systems, devices, components or elements may be directly connected, or may use intervening components or elements to aid a connection. In the latter case, if the intervening systems, devices, components or elements are well known to those in the art then they may not be described herein or shown in the accompanying figures for the sake of clarity.

As used herein the term "operable to" means "functions to" unless the context, common sense or knowledge of one skilled in the art indicates otherwise.

By "throat" of a swing machine is meant the distance from the back of the sewing harp to the needle (see for example, https://en.wikipedia.org/wiki/Longarm_quilting). By "usable throat distance" is meant a value (i.e., distance) of a long-arm machine that is measured by subtracting an accumulated dimension of the sewing head structure (measured from the needle to the inside surface of the head) and the rolled, quilt diameter on a roller (usually equal to a distance that allows for a maximum length of quilt to be rolled that has the thickest batting layer and fabric layers) from the total throat distance, which is where the head structure will be stopped. This accumulated dimension is typically eight inches, or more.

By "lengthwise" is meant a component that is substantially longer in dimension than it is in width, where the clamps depicted in FIG. 1 are not lengthwise clamps.

It should be understood that when used herein, the designations "first", "second", "third", etc., are used to distinguish one component or element of a system or device or part of a process from another and do not indicate an importance, priority or status unless the context, common sense or recognized knowledge of those skilled in the art indicate otherwise. In fact, in some cases the component or elements of a process could be re-designated (i.e., re-numbered) and it would not affect the scope of the present invention.

It should be noted that the systems, devices, as well as any components, or elements thereof, illustrated in the figures are not necessarily drawn to scale, and need not be representative of an actual shape or size and need not be representative of any actual device. Rather, the systems, devices, components and elements are drawn so as to help explain the features, functions and processes of various exemplary embodiments of the present invention described herein.

Relatedly, to the extent that any of the figures or text included herein depicts or describes dimensions, weights, forces or operating parameters it should be understood that such information is not meant to be limiting unless expressly stated, is merely exemplary and is provided to enable one skilled in the art to make and use an exemplary embodiment of the invention without departing from the scope of the invention.

As used herein, the terms "embodiment" and/or "exemplary" mean an example that falls within the scope of the invention(s).

The present invention provides devices and related methods to reduce undesirable distortions of finished, quilted products. It should be understood that the term "finished, quilted product" includes substantially all of the intermediate products that use multiple layers of fabric and batting material that are formed before, and at the time, a finalized version is formed, where it is understood that material that forms a batting layer is composed of a different material than the backing layer. For example, the backing layer may be composed of a cotton fabric (e.g., fleece fabric (Minky), or a shaggy fabric with long hair-like finish (faux fur)) while the batting layer may be composed of loose, unwoven fibers, which may be of a different origin than either the top material fibers or the backing material fibers (e.g., cotton, wool, bamboo, silk, or polyester).

In one exemplary embodiment, a fixation device may be positioned along a portion of an exposed side edge of a backing layer ("selvage edge portion" or "edge portion"). As explained further herein, so positioned the device may be operable to substantially fix the entire side edge in addition to the edge portion in substantially one position or orientation (collectively "position") by applying a substantially uniform force to the edge portion as each corresponding section of the backing layer receives a quilt sewing process. A pair of such fixation devices may be positioned along the opposing side, selvage edges, with each fixation device applying substantially the same force to a respective edge portion.

In an embodiment each of the fixation devices may be substantially across from one another. As a result, substantially the entire side edge of one or more layers (e.g., backing layer) may be fixed in one position, thus allowing the warp and weft threads of the backing layer to substantially maintain a proper orientation during a subsequent process that involves attaching (e.g., stitching) the layer (e.g., backing layer) to additional layers making up a finished, quilted product.

Figure 2A:
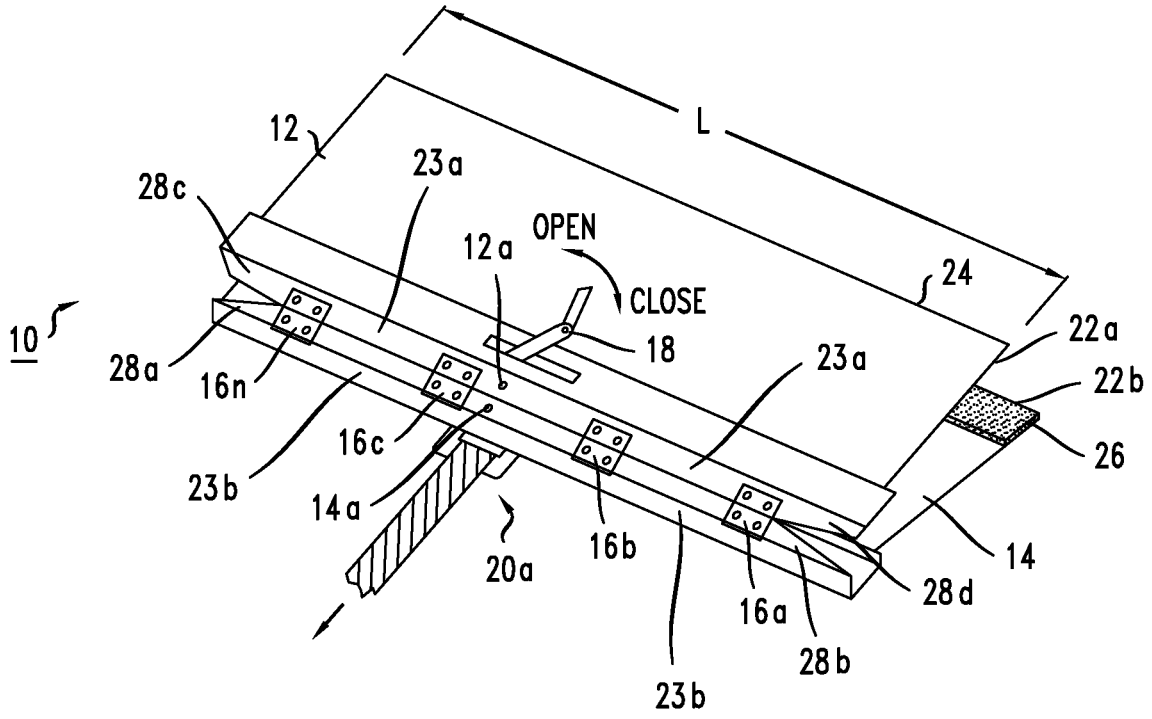
FIG. 2A depicts an exemplary inventive device operable to fix the backing layer of a quilted product, for example, in order to reduce distortion in the layers of the finished quilted product according to embodiments of the invention.

Referring now to FIG. 2A there is illustrated an exemplary fixation device 10 according to one embodiment of the present invention. As shown, fixation device 10 may comprise one or more hinges 16*a* to *n* (where "n" indicates a last hinge) a first lengthwise component 12, a second lengthwise component 14, and a lever 18. In an embodiment, a lower section 18*c* of the lever 18 (see FIG. 4C) may be securely connected to the second lengthwise component 14 by one or more pins (e.g., two pins), The one or more hinges 16*a* to *n* may be operable to form a hinged spine 16 for hingably connecting (i.e., connect using one or more hinges) the components 12, 14 together and further allow the components 12, 14 to hingably move as explained further herein. In embodiments, the one or more hinges 16 *a* to *n* may also collectively function to control or fix a spatial relationship between the two components 12, 14 as the two components 12, 14 are hingably moved together or apart. In addition, the hinges 16*a* to *n* function to restrict the movement of components 12, 14 with respect to one another (i.e., insure alignment) in order to insure proper functioning of the device 10 and structural stability (e.g., if the components 12, 14 are misaligned the device 10 may break and/or a layer may be distorted). Each of the hinges 16*a* to *n* may be configured as separate specific hinge (e.g., house door hinges) or, alternatively, as a continuous strip, often referred to as a "piano hinge" to name just a few of the type of additive hinges that may be used.

Figure 2B:
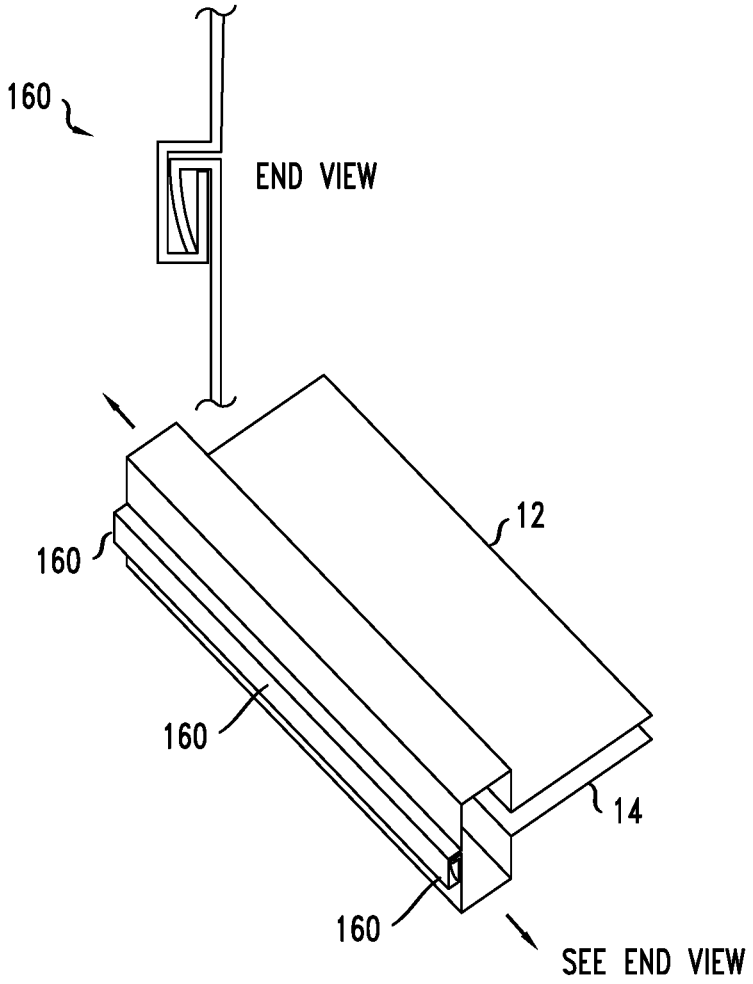
FIG. 2B depicts an exemplary hinge element of an inventive device according to an embodiment of the invention.

Yet further, rather than include individual separate hinges 16*a* to *n*, an inventive fixation device may include a single long hinge 160 formed along substantially all of the lengthwise, opposing, facing and contacting edges 23*a*, 23*b* of components 12, 14 as shown in FIG. 2B.

Still further, device 10 may be separated into two separate devices, for example, a first device that comprises at least a first component 12 and a second device that comprises at least a second component 14, where one of the components 12, 14 is stationary with respect to other component. The non-stationary component may be moved by applying a force to it towards the stationary component using a detachable or non-detachable means for applying a force to a fabric (e.g., a lever). The detachable or non-detachable means for applying a force may be fixed or detachably fixed to the stationary component, and then operated to apply a force to the non-stationary component to move the components to a closed or locked position to fix an edge portion of one or more layers of a quilted product between the components (or vice-versa, to an open position).

In an embodiment, an edge portion 25*a* of one or more layers of material (e.g., a backing layer 25; edge portion not shown in FIG. 2A, but see FIG. 4A) may be positioned between the two lengthwise components 12, 14. Once positioned, or substantially when the layer, such as a backing layer, is so positioned, a first force may be applied to the lever 18 which, in turn, applies a second force corresponding to the first force multiplied by the leverage ratio of lever 18 (i.e., see FIG. 4C; ratio of a horizontal lever length measured from top portion 18*b* to the position of the transverse pin 14*a* at opening 18*d* versus the horizontal length of the incline of edges surfaces 18*a* to the position of the transverse pin 14*a* at opening 18*d*) to the first lengthwise component 12 in order to move the first component 12 towards the second component 14, for example, to fix the edge portion 25*a* of a backing layer 25 there between. The second force may vary with the angular position of the lever 18 from a factor of about five to over fifty times. The leverage ratio of component 12 and 14 may reduce the force by five times, but the net gain is such, for example, that a one pound of force on the lever 18 may produce ten pounds of force at the gripping point on component 12 and 14, for example. The originating, first force may be applied by a user or by an automated or semi-automated system (e.g., an electronic controller or programmable logic controller and motor connected to hinges 16*a-n* of device 10 to hingably move the hinges 16*a-n*, for example). Because the second component 14 is substantially stationary with respect to the lower section 18*c* of the lever 18 and the first component 12, as the first component 12 moves towards a "closed" position with respect to the second component 14, at least the first component 12 applies a force to an edge portion 25*a* of the layer 25 that has been positioned between the components 12, 14. In an embodiment, an exemplary amount of force required to fix in position a portion of a backing layer between components 12, 14 may be approximately half a pound of force per linear inch of component 12. In an embodiment, when component 12 is 18 inches the exemplary force may equal nine pounds when a gripping layer (e.g. layer 22*a*) is included as a part of component 12.

In an embodiment, the force applied by the first component 12 to the one or more layers (e.g., backing layer) is sufficient to, for example, fix in position the edge portions of the backing layer between the components 12, 14. Collectively, such positions of the lever 18, components 12, 14 and one or more layers there between may be referred to as a "locked" state, where in this case the term "locked state" means a state where the edge portions of the one or more layers are fixed in position between components 12, 14 so that the layers are substantially prevented from moving and the lever 18 is latched so that it will not move, but it does not imply that the device itself is "locked" and incapable of being opened. Because the edge portion(s) of the gripped backing layer is so fixed, so too is substantially the entire edge of the layer to be quilted substantially fixed in one position thereby resulting in a reduction of distortion to the layer or layers.

It should be noted that the "locked" state provides additional advantages over existing devices and methods. Besides fixing the edge portion(s) in one position, this state may also reduce the need for a user of device 10 or an automated/semi-automated system to apply an excessive force to components 12, 14 and layer(s) to insure the layer(s) remains fixed. This may substantially reduce the strain on a user's hands.

In an embodiment, each of the components 12, 14 may optionally include one or more shaped, relief corner edge surfaces 28*a*, 28*b* and 28*c*, 28*d* respectively for reducing binding of the backing layer 25. In one embodiment, the shape may comprise diagonally surfaces 28*a*, 28*b* and 28*c*, 28*d* that form a substantially V-shaped relief. Such surfaces may be configured substantially proximate to one of the hinges 16*a* to *n* forming hinged spine 16. It is believed that the use of the diagonal surfaces may offer advantages over a configuration that does not use such surfaces (e.g., where no end fabric relief is used; instead the corner edges of components 12, 14 are rectangular or "squared off"). It is believed that a layer near rectangular or "squared-off" corner edges of components 12, 14 may tend to bind up as the layer is drawn between components 12, 14 because of significant width variations in the backing layer. In contrast, the use of the relief corner edge surfaces functions to guide the layer in order to reduce the possibility of such binding.

In an embodiment, in an "open" state (no layer fixed in between) a distance between component 12 and 14 may be 2 inches measured vertically from the top surface of the second component 14 to the bottom surface of the first component 12, for example. Advantageously, the substantially flat sections 19*a* (see FIG. 3B) of each component 12,14 may be configured to receive a wide range of material layer thicknesses while at the same time reducing the force needed to move the components 12, 14 and lever 18 to a "locked" position. Further, such a configuration minimizes the chances that the components 12, 14 will become deformed or break in a closed or locked position. In an embodiment, when the components 12, 14 are composed of aluminum, the combination of hinges 16*a* to *n* and inside surfaces of components 12, 14 (e.g., gripping surfaces 22*a*, 22*b*) function as a cantilevered leaf spring thereby accommodating significant deflection without causing failure of elastic deformation.

Transverse pin 14*a* (referred to as "second transverse pin"; pin 12*a* discussed below being the "first transverse pin") functions to securely connect a lower section 18*c* (see FIG. 4C, where pin 14*a* passes through opening 18*d*) of lever 18 to the component 14 such that the lower section 18*c* of lever 18 and component 14 are fixed in the same position with respect to the first component 12. Further, an optional high traction, non-skid, gripping layer 22*a*, 22*b* (e.g., strips), respectively, may be positioned on (or made integral to) the inside, outer edges 24, 26 of each component 12, 14. Each layer 22*a*, 22*b* may extend substantially the entire length of a lengthwise edge of component 12, 14, or, alternatively may be positioned along sections of an entire edge. Such gripping layers 22*a*, 22*b* function to contact the edge portion(s) of a backing layer fixed between the components 12, 14 and increases the force applied to an edge portion in order to further fix in position the edge portion 25*a* between components 12, 14 by reducing or substantially eliminating movement of the edge portion(s) 25 between the components 12, 14 (i.e., further fixes the edge portion(s) between components 12, 14). In an embodiment, the gripping layers 22*a*, 22*b* (or if they are separated into sections, gripping layer sections) may be composed of a non-skid foam (e.g., a closed cell, ethylene propylene diene monomer material with a high coefficient of friction surface). Further, when additional force is applied to a component 14 (see discussion of tensioning herein) the gripping layers 22*a*, 22*b* apply a gentle force to the edge portion of the layer of material (e.g., backing layer) in a uniform manner.

In an embodiment, the overall weight of the device 10 may be approximately 7 ounces or less. Further, each of the components 12, 14 may be composed of a lightweight material (e.g. aluminum). Thus, the device 10 is lightweight (i.e., approximately 7 ounces or less). An additional advantage of the inventive lightweight designs described herein is that the forces being applied to the layer or layers of material positioned in between components 12, 14 due to the weight of a component 12, 14 may be reduced which contributes to maintaining each layer in a fixed position to reduce the amount of distortion of an edge portion as compared to existing devices. In an alternative embodiment, device 10 may weigh more than 7 ounces if required for additional stability.

Figure 2C:
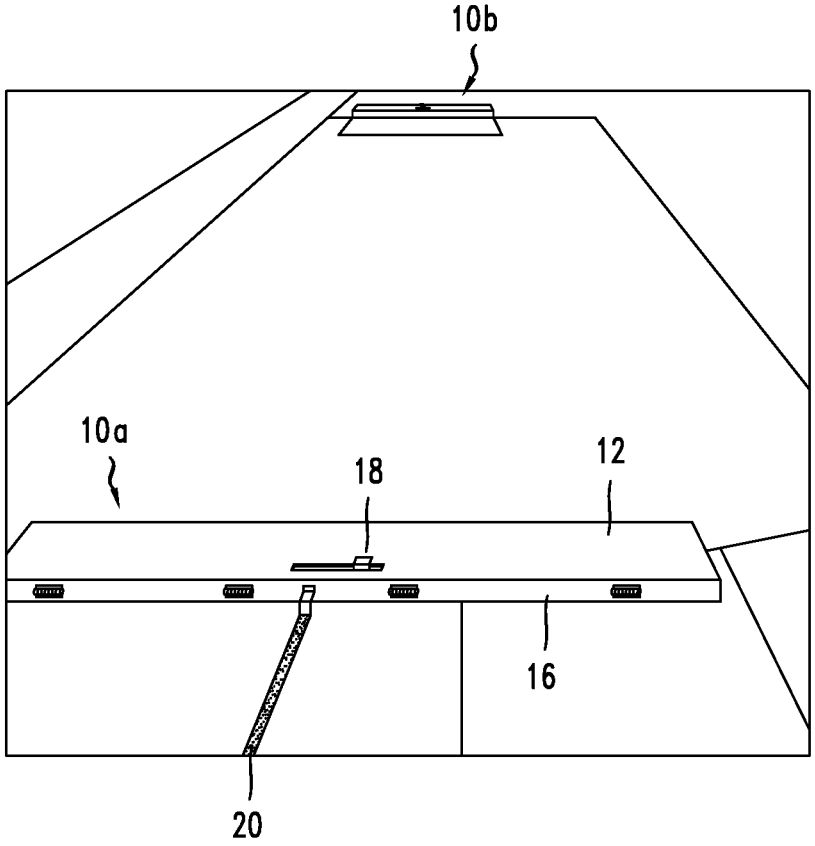
FIG. 2C depicts two exemplary inventive devices operable to fix the backing layer of a quilted product.

Referring now to FIG. 2C there is depicted two inventive fixation devices 10A and 10B positioned on opposite sides of a backing layer 25. Each device 10A, 10B may include one or more of the inventive features of the device 10 (or 100, see below). As depicted, so positioned, fixation devices 10A, 10B substantially fix in position respective edge portions of the backing layer 25 within respective first and second components as described elsewhere herein, and thereby reduce distortions in the layer 25, and subsequently, in a finished quilted product.

Figure 3A:
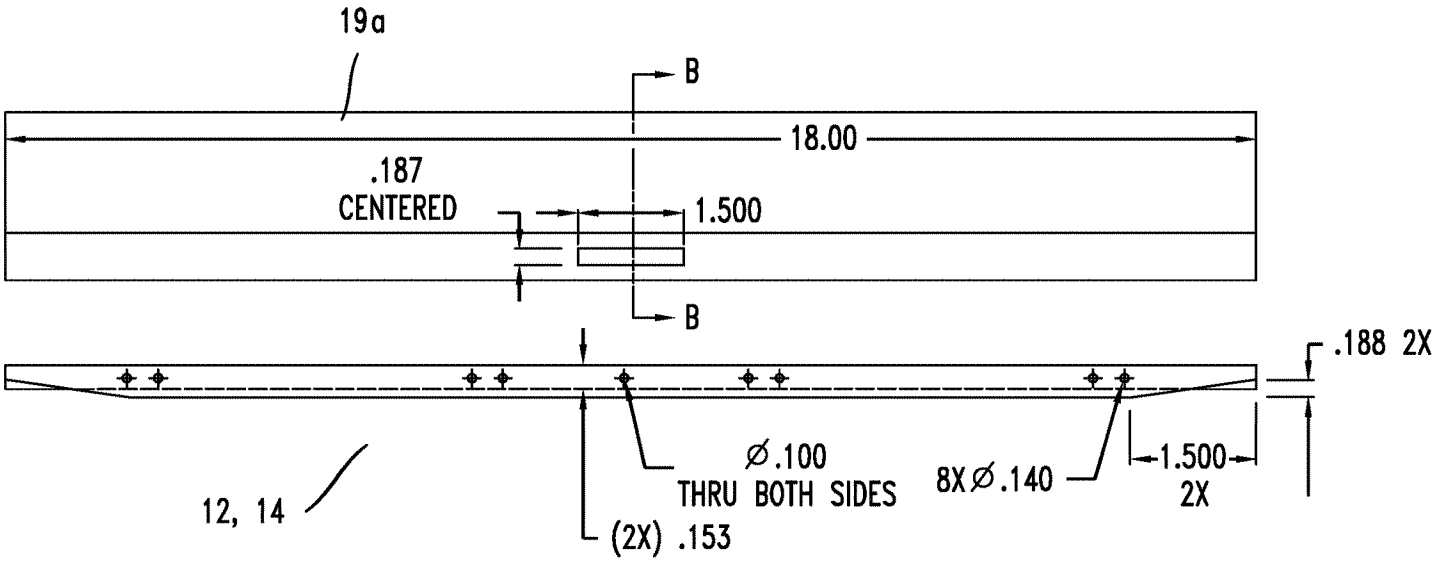
FIGS. 3A to 3C depict different views of a component of an exemplary device according to embodiments of the invention.
Figure 3B:
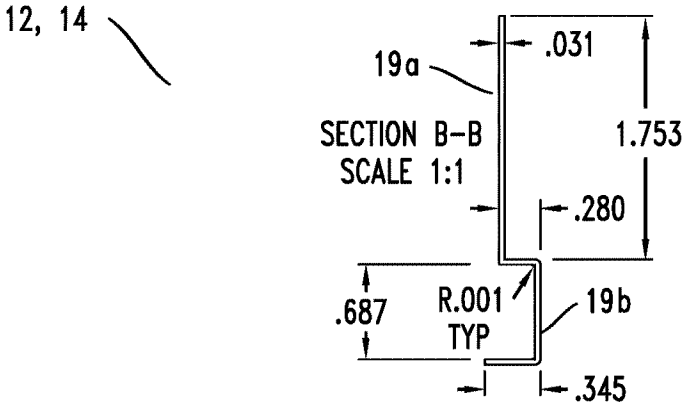
Figure 3C:
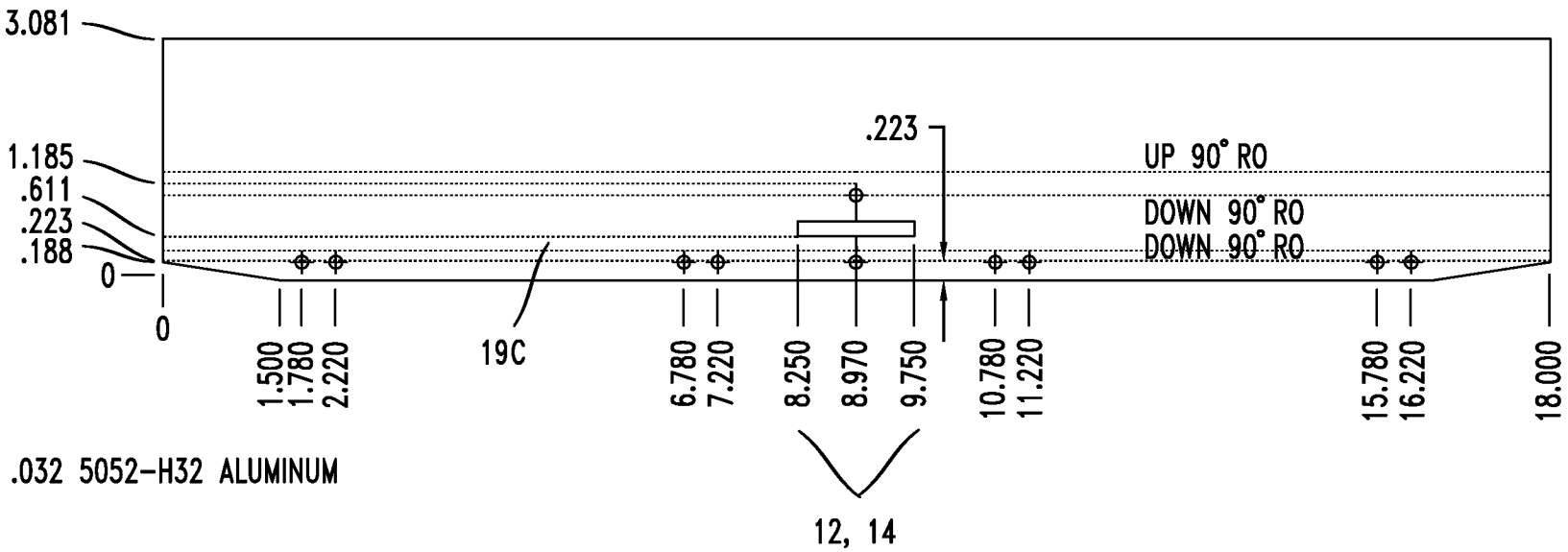

Referring now to FIGS. 3A to 3C there are depicted views of an exemplary component 12 or 14 that includes exemplary, non-limiting dimensions. In embodiments, an exemplary, separate lengths of a component 12, 14 may be 15 inches up to 18 inches while an exemplary width may be 2 inches. The dimension of the width may vary depending, for example, on the type and characteristics of the layers of material (e.g., fabric) sought to be fixed between the components 12, 14 and/or the thickness of such a layer or layers while the length of components 12, 14 may vary depending, for example, on the usable "throat" distance of a sewing machine. For example, if the "throat" of a sewing machine is 26 inches the usable distance may be 18 inches. Thus, the length of a component is 18 inches or less. It should be understood that the foregoing dimensions are merely exemplary. In sum, the length of components 12, 14 may be said to be "throat length" dependent.

In an embodiment, the width of an exemplary component 12, 14 should be wide enough to cover a portion of a layer or layers (e.g., backing layer), for example, without the need to precisely position a portion of the layer or layers (e.g., backing layer) between components 12, 14. Said another way, the width cannot be too narrow in order to reduce the risk that the portion of layer or layers slip out from between components 12, 14 as the components 12, 14 move towards a "closed" or "locked" state. Further, while the length of each component 12, 14 is shown substantially the same in the figures, in an alternative embodiment the length of one of the components 12, 14 may differ from the length of the other component (separate, different lengths) yet still be substantially within the range of 15 inches up to 18 inches. Yet further, while the width of each component 12, 14 is shown substantially the same in the figures, in an alternative embodiment the width of one of the components 12, 14 may differ from the width of the other component (separate, different widths) yet still be substantially within the range of 2 inches.

In alternative embodiments, the length of the first and/or second lengthwise components 12, 14 may be less than 15 inches and/or greater than 18 inches and the width may be greater than 2 inches or less than 2 inches (e.g., 1 inch to 3 inch width).

As shown in FIG. 3B, each of the components 12, 14 may comprise substantially flat, lengthwise sections 19*a* and substantially right angle, bend sections 19*b*, the latter sections functioning to provide rigidity and strength to each component 12,14 to reduce or prevent potential bowing in the event of non-uniform pressures across the length of a component 12, 14.

Figure 3D:
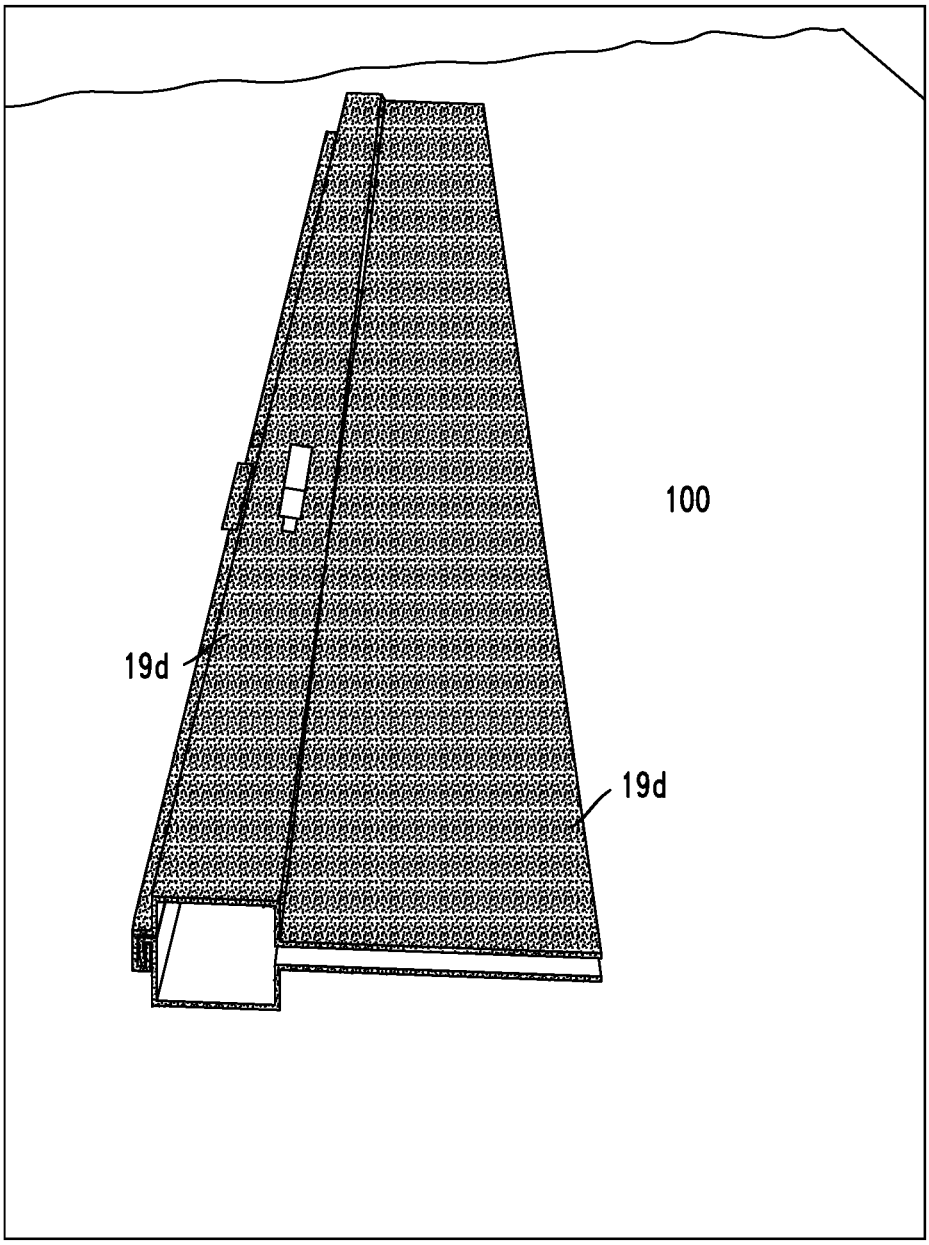
FIG. 3D depicts an alternative device according to an embodiment of the invention.

Referring to FIG. 3D there is shown an alternative exemplary device 100. The device 100 may include the same or similar features as device 10. In addition, at least the first and second components may include one or more coatings 19*d* that functions to reduce the transfer of oxidants to a quilted product that may form on a surface of a non-treated component 12, 14. In an embodiment the coating may be selected from a powder, paint, or plating, for example. Alternatively the color may be inherent to a plastic if the component 12, 14 is composed of such a plastic. The coating may also be designed for strictly ornamental purposes (i.e., user appeal).

Referring back to FIG. 2A the device 10 may further include one or more brackets 20*a* to *n* (only one exemplary bracket 20*a* is shown in FIG. 2A). In an embodiment, a bracket 20*a* may be configured such that it is connected to substantially the center of a lengthwise section 19*a* of a component, such as second component 14. It is believed that connecting a single bracket 20*a* in the center of a component 14 of an inventive fixation device 10 may distribute forces applied to the device 10 by a tensioning means 21 described further below.

Figure 2D:
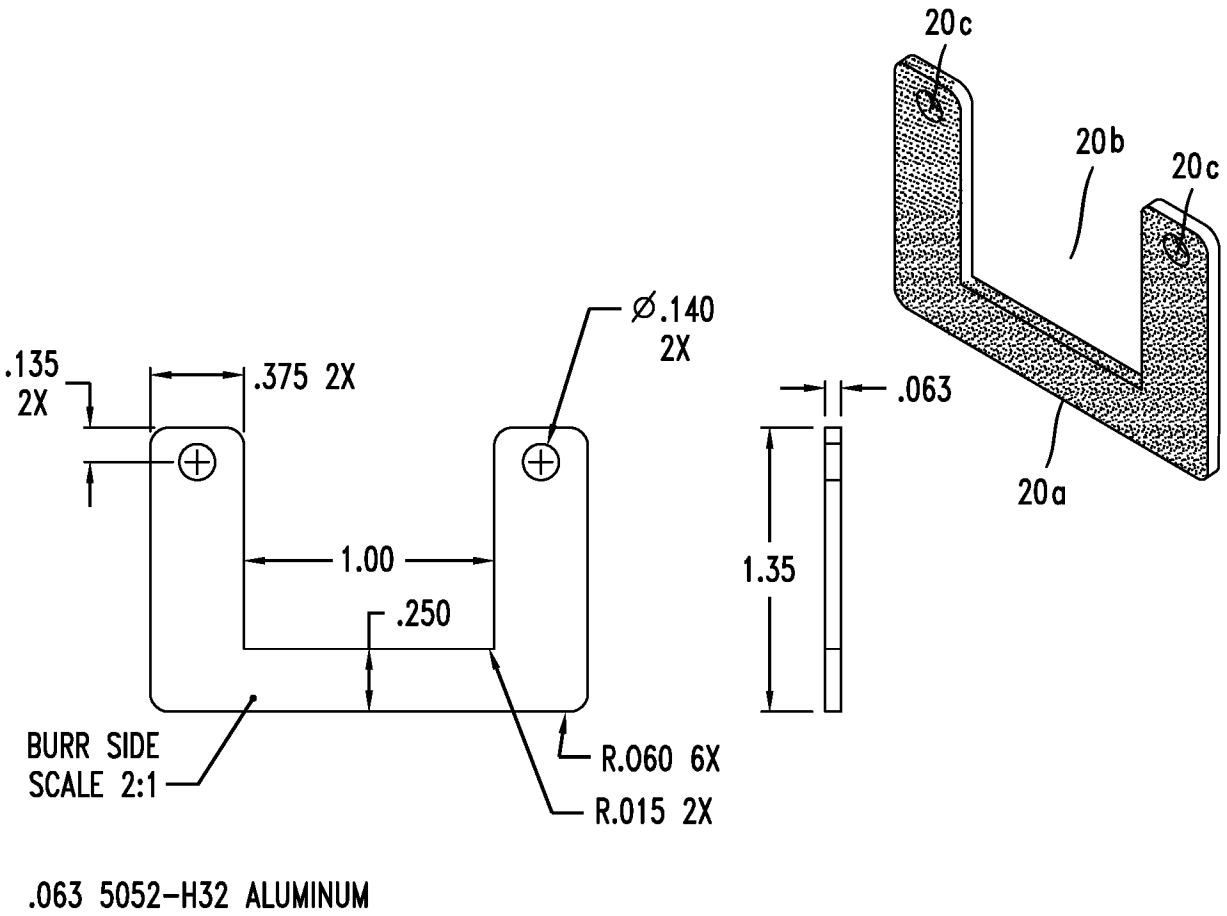
FIGS. 2D and 2E depict exemplary elements of an exemplary inventive device operable to fix the backing layer of a quilted product.

In an embodiment one side of a bracket 20*a* may be securely connected to the second component 14 using screws or welds, for example, the former using openings 20*c* in FIG. 2D. FIG. 2D also illustrates exemplary, non-limiting dimensions (and shape) of an exemplary-shaped bracket 20*a* according to an embodiment of the invention, it being understood that the shape and dimensions may vary depending on the application.

Figure 2E:
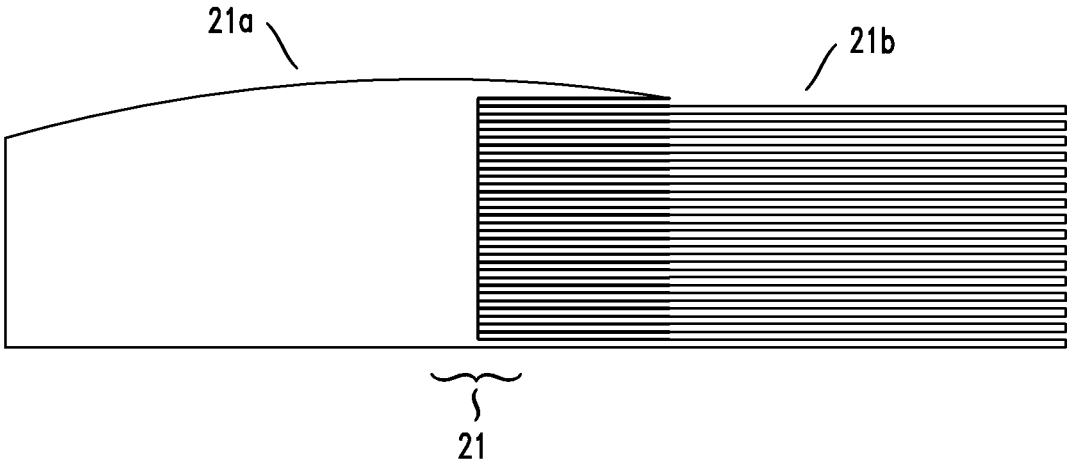

As shown in FIG. 2D, each of the brackets 20*a* may include an opening 20*b* to receive tensioning means 21. Referring now to FIG. 2E there is depicted an exemplary tensioning means 21 for applying a substantially uniform force along the entire length of the edge portion 25*a*. The tensioning means 21 may comprise a partially elastic, multi-functioning strap, The strap 21 may include an elastic portion 21*b* (e.g., woven elastic braid; an elastic strand inside a fiber sheath woven into a flat strap-like configuration) and a substantially non-elastic, multi-surface, self-tightening portion 21*a*. Portion 21*a* may further include male and female Velcro surfaces (e.g., Velcro loop and hook surfaces) for self-tightening. In an embodiment, the elastic portion 21*b* may be received and secured to the opening 20*b* in a bracket 20*a* to *n* while the self-tightening portion 21*a* may be secured to another position, such as a position located on a quilting machine. In an embodiment the length of the elastic portion may be 1 foot while the length of the non-elastic portion varies depending on the width of the quilt product. It should be noted that the length of the elastic portion should take into account the width capacity of the quilting machine.

In an embodiment, when the components 12, 14 and lever 18 are in a "locked" state, and an edge portion of a backing layer has been fixed in position between components 12, 14, the self-tightening portion 21*a* of the tensioning means 21 may be tightened by a person or automated/semi-automated device by applying a force to, for example, the male and female parts of Velcro® surfaces. As a result, a substantially uniform force may be applied to entire length L of edge portion(s) of the layer In another embodiment, a quilting process may occur. Such a process may apply forces (e.g., downward forces) to an edge portion of a backing layer fixed in between components 12, 14 while the device 10 is in a "locked" state. Such forces may cause distortions in the fixed edge portion as puffy sections between sewing lines of a quilt cause a general shortening of the original fabric's dimensions. This may be expected and, if controlled, provides uniform shrinkage in all directions. If an existing, non-inventive rigid, non-elastic, tensioning strap is used the tension may change during the quilting process (e.g., sewing step), thus causing the process to become uncontrolled which leads to distortions in a finished quilt product. To avoid this scenario, the elastic portion 21*b* of the inventive tensioning means 21 functions to absorb such forces. However, the existence of the non-elastic portion 21*a* functions to control the amount of shrinkage on varying width quilts as compared to the use of a substantially elastic strap because the elasticity of the inventive tensioning means 21 is less than the elasticity of an existing strap. Said another way, a completely non-elastic strap is too rigid and requires reattachment to the frame of a quilting machine each time the quilt materials are advanced, while a completely elastic strap requires either short pulls or long pulls depending on whether it is a wide or narrow quilt. To avoid such issues the inventors provide for a strap 21 that combines non-elastic 21*a* and elastic 21*b* portions.

Additionally, because the inventive non-elastic portion 21*a* functions to limit the amount of elasticity of tensioning means 21, when the need arises to remove device 10 from a backing layer (or re-attach it) a reduced amount of force is required to remove the tensioning means 21, and, thus, a reduced amount of force is applied to the portion of the backing layer in between first and second components of a device 10, 100 as compared to existing devices. This reduced amount of force results in a reduction in distortion of the backing layer.

Figure 4A:
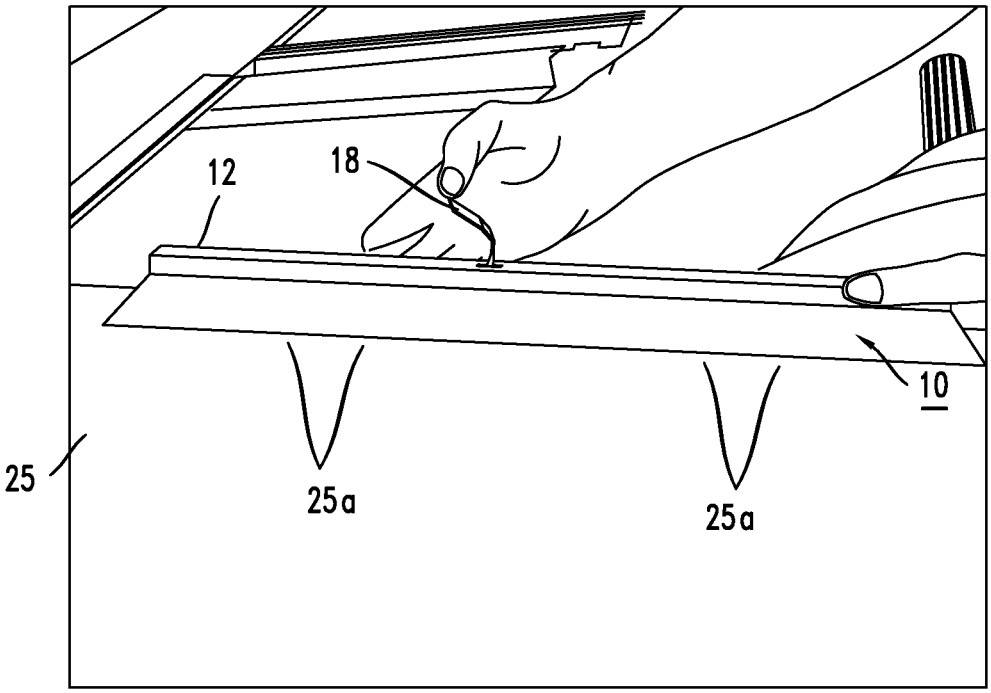
FIGS. 4A and 4B depict exemplary "open" and "closed" or "locked" states of an exemplary device according to embodiments of the invention.
Figure 4B:
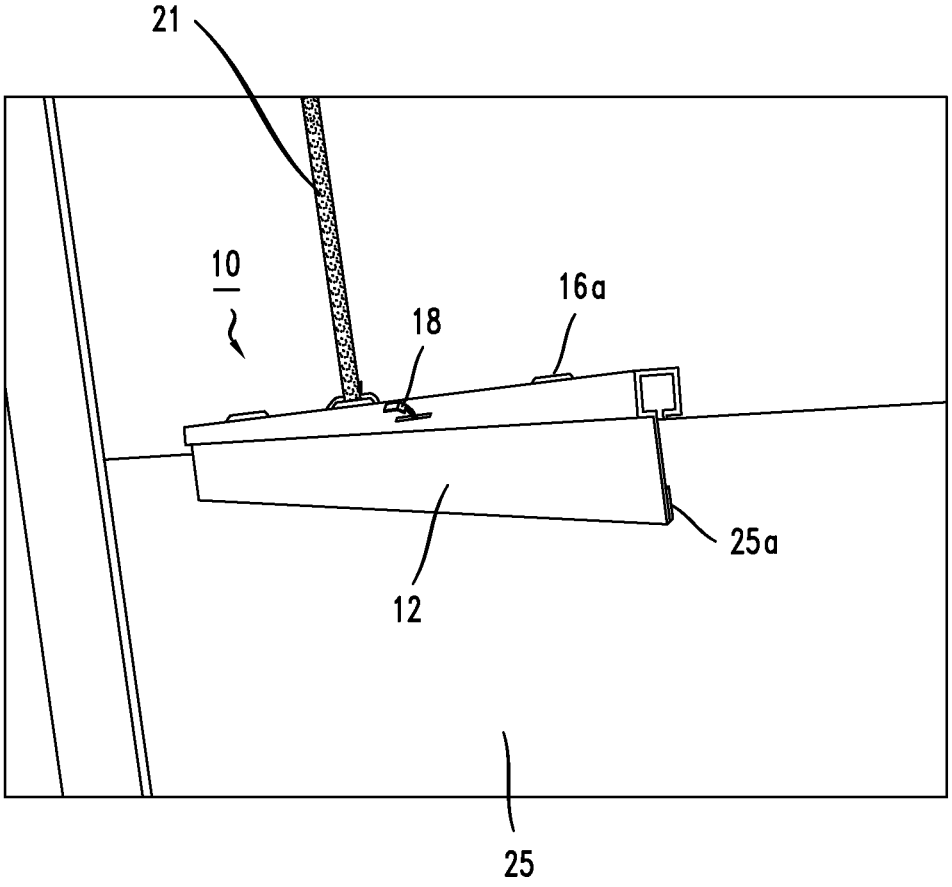

FIG. 4A illustrates an exemplary lever 18 and components 12, 14 of device 10 (component 14 is hidden by backing layer 25) in an "open" state according to an embodiment of the invention, while FIG. 4B illustrates an exemplary lever 18 and components 12, 14 of device 10 (component 14 is again hidden by backing layer 25) in a "locked" state (i.e., the lever 18 is substantially parallel to component 12).

According to an embodiment of the invention. It should be understood that this embodiment is preferably used when automatic or semi-automatic equipment is not used to fix an edge portion of each layer or layers within components 12, 14. If such equipment is used sections of component 18 may be varied (e.g. top portion 18*b* may not be necessary, see FIGS. 4C and 4D).

From the views in FIGS. 4A and 4B it can be seen that the formed hinged spine 16 may be operable to function to rotate or otherwise move to allow for the components 12, 14 to be opened, closed and/or locked sufficiently in order to easily insert or remove one or more layers 25 of a quilted product having a range of thickness(es).

Figure 4C:
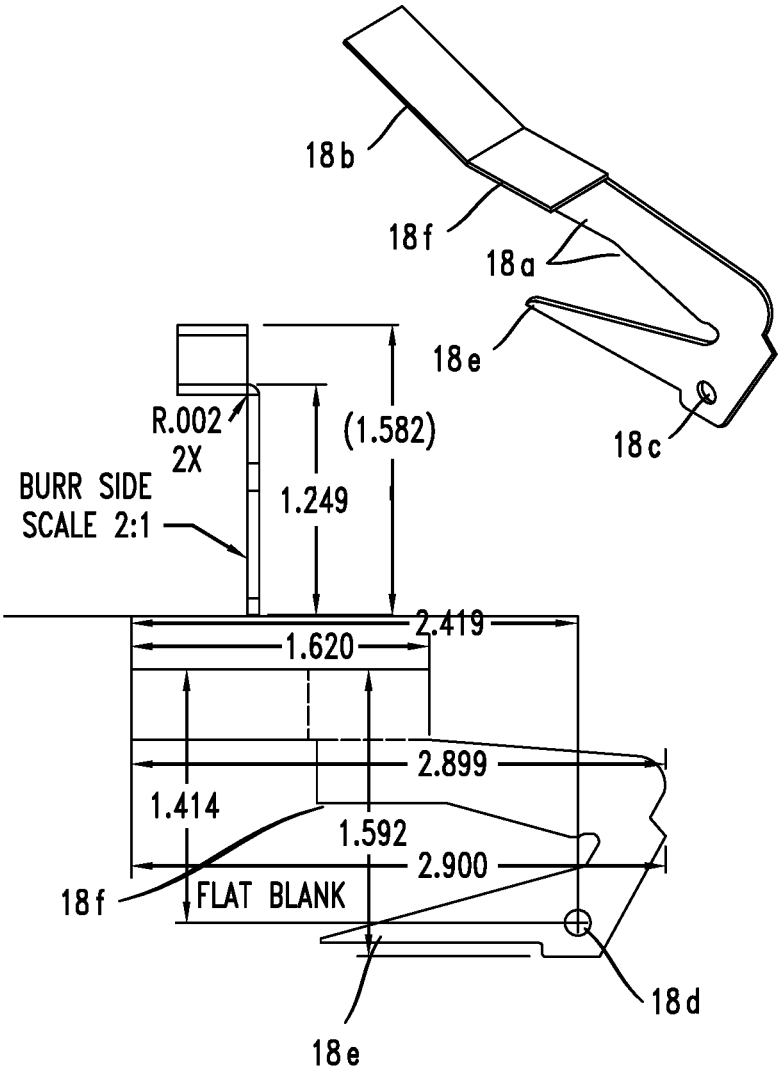
FIGS. 4C and 4D depict an exemplary configuration and exemplary, non-limiting dimensions of a lever component of an inventive device according to an embodiment of the invention.
Figure 4D:
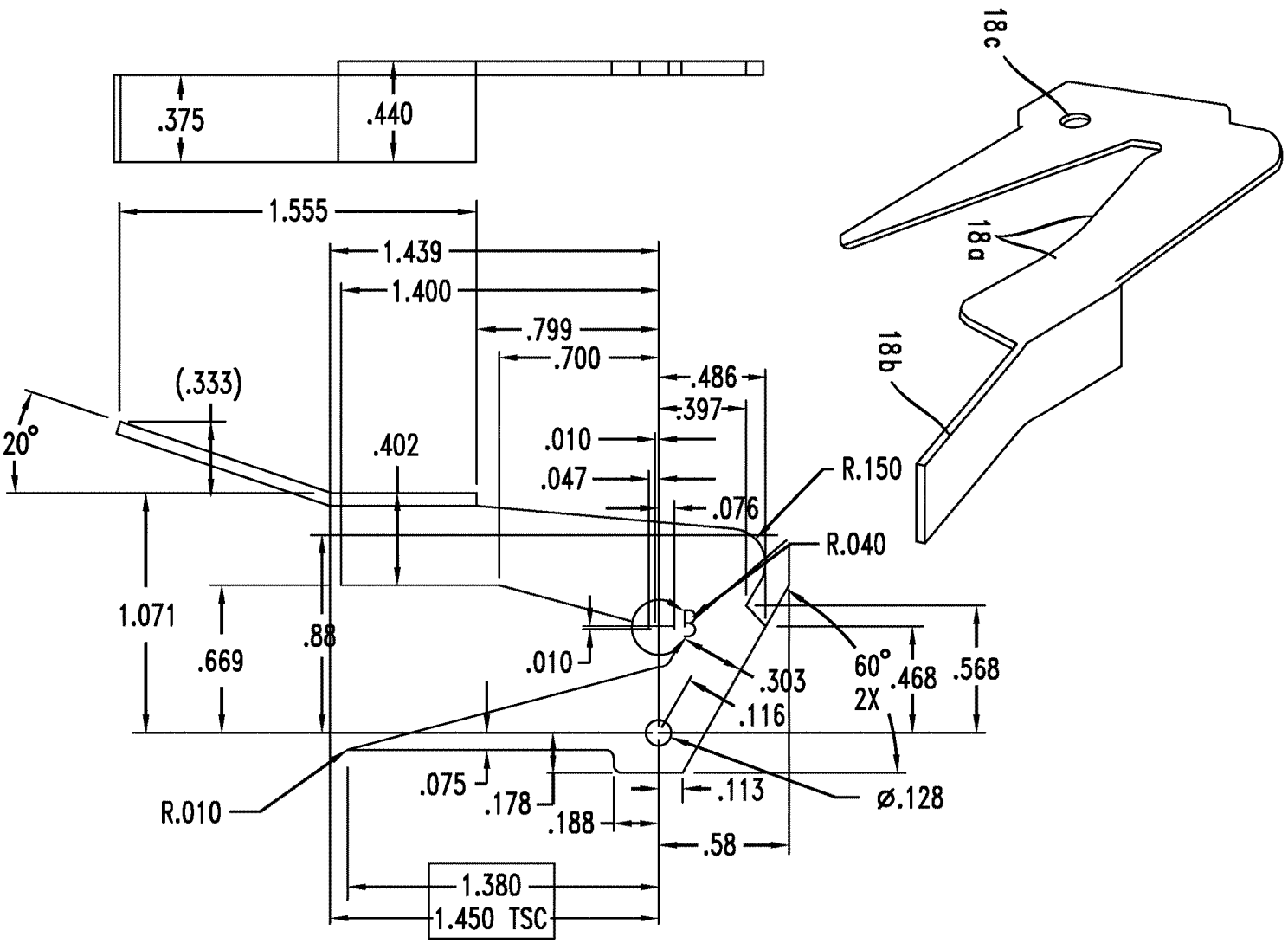
Figure 4E:
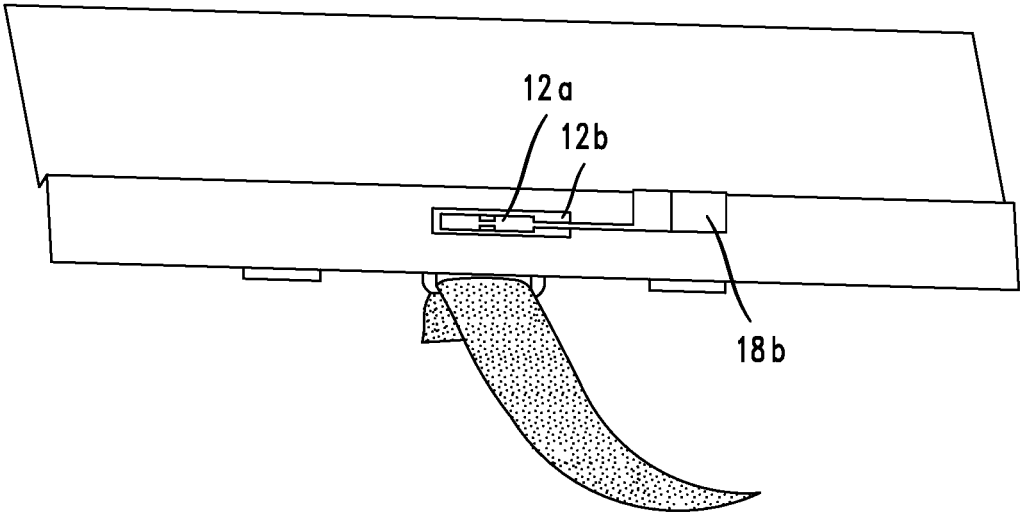
FIG. 4E depicts an exemplary lever element positioned within an opening of an inventive device according to an embodiment of the invention.

Referring now to FIGS. 4C and 4D there are depicted views of an exemplary lever 18 in accordance with an embodiment of the invention. The lever 18 may be configured within an opening 12*b* of component 12 (see FIG. 4E) and may comprise edge surfaces 18*a*, a top portion 18*b* and a lower portion 18*c*. In an embodiment, the lever 18 (i.e., its edge surfaces 18*a*, top portion 18*b*, lower portion 18*c*) and transverse pin 12*a* may be configured to minimize the force needed to move the component 12 towards component 14 (or vice-versa) to a closed and/or locked position.

Accordingly, in an embodiment lever 18, that is securely connected to the first lengthwise component 12 by a first transverse pin 12*a* and to the second lengthwise component 14 via lower section 18*c* by a second transverse pin 14*a*, may be operable to move the first component 12 towards the second component 14 to fix in position an edge portion 25*a* of a backing layer 25 within the first and second lengthwise components 12, 14 and, conversely, move the first component 12 away from the second component 14 to release the edge portion 25*a* of the backing layer 25 from within the first and second lengthwise components 12, 14.

In more detail, top section 18*b* may comprise a substantially flat section and may function as a top or handle section operable and configured to reduce the chances that a user would injure a finger or hand upon applying a force to section 18*b*.

In an embodiment when a downward force is applied to top section 18*b*, surfaces 18*a* are configured to slidably move downward against the transverse pin 12*a* ("first transverse pin") connected to component 12 forcing the component 12 to hingably move downwards to (towards, closer to) component 14. In one embodiment, component 14 is securely connected to the bottom portion 18*c* of lever 18 by second transverse pin 14*a* which may be inserted through opening 18*d* in FIG. 4C. The configuration of transverse pins 12*a*, 14*a* and surfaces 18*a* function as a "cam" to slidably guide the movement of component 12 with respect to component 14 such that varying thicknesses of edge portions of one or more layers of a material (e.g., a backing layer fabric) may be fixed in position between components 12, 14 (e.g., from a relatively thick material to a relatively thin material, or a napped material). As the lever 18 rotates from an "open" state to a "locked" state (position), the pointed section 18*e* rotates towards component 14 and substantially straight lower edge 18*f* approaches component 12. The combination of movements of components 12, 14 and 18 ensures that the forces applied to component 18 do not damage the transverse pins 12*a*, 14*a*.

Figure 4F:
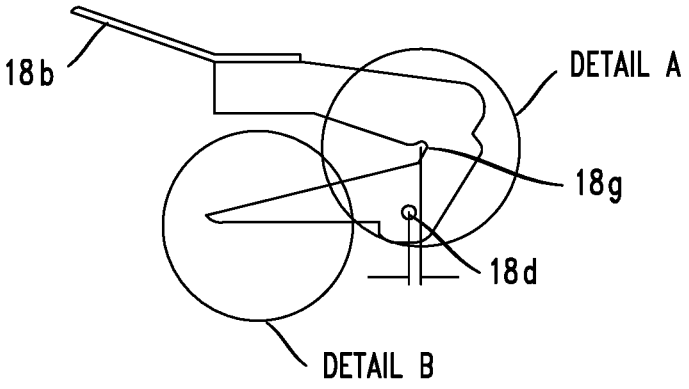
FIGS. 4F to 4H depict close-up details "A" and "B" of a lever element according to an embodiment of the invention.
Figure 4G:
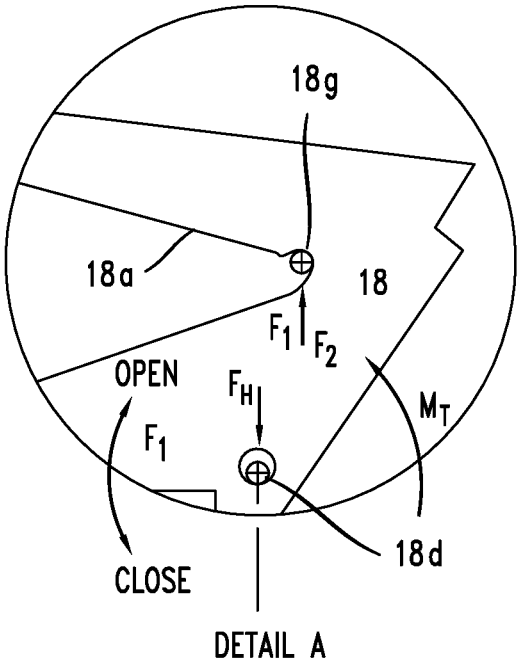
Figure 4H:
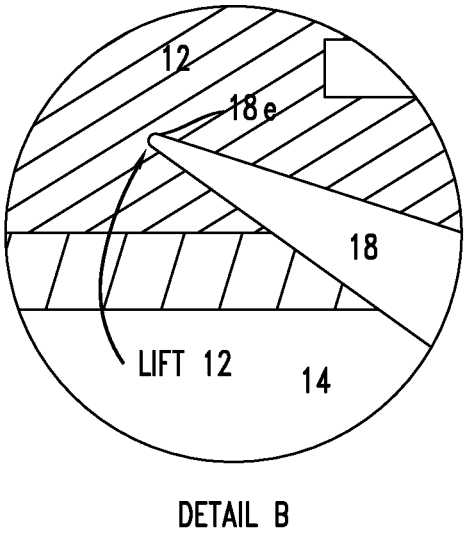

Referring now to FIGS. 4F to 4H, two details, "A" and "B" of an exemplary lever 18 are depicted for clarity. FIG. 4F depicts both details A and B while FIG. 4G depicts detail A and FIG. 4H depicts detail B.

Referring first to FIG. 4F, points 18*d*, 18*g* represent the points of contact for transverse pins 14*a*, 12*a*, respectively. In an embodiment, transverse pin 12*a* may be slightly offset (in the figure, to the right) of transverse pin 14*a* in order to maintain the structural stability of the device 10 while in a "locked" position.

Referring now to FIG. 4G, detail A depicts a close up view of both points of contact 18*d*, 18*g* with exemplary forces $F_1$, $F_2$ representing the direction of the forces applied by the respective transverse pins, 14*a*, 12*a*. In an embodiment, forces $F_1$, $F_2$ may be equal. Such balanced forces function as a "couple" in order to move the lever 18 counterclockwise (for example). However, such motion is opposed by two smaller horizontal forces (not shown) that resist with a clockwise couple. In an embodiment, in order to move the lever 18 clockwise (to move the components 12, 14 to an "open" state), additional force must be applied (by a user or equipment) to the lever top portion 18*b* to move a lower part of surface 18*a* past the pin 12*a* located at position 18*g*, which then releases force on pin 12*a* as the components 12, 14 move to an "open" state. Continued clockwise movement of the lever 18 brings the pointed tip 18*e* of the lever 18 up under component 12 and raises it, such that components 12,14 move to a fully "open" state as shown in FIG. 4H, detail B.

It should be understood that the foregoing description only describes a few of the many possible embodiments that fall within the scope of the inventions. Numerous changes and modifications to the embodiments disclosed herein may be made without departing from the general spirit of the invention, the scope of which is best defined by the claims that follow.

The invention claimed is:

1. A device for reducing the distortion of a quilted product comprising:

a first lengthwise component having a length of fifteen to eighteen inches wherein a first transverse pin is connected thereto;

a second lengthwise component having a length of fifteen to eighteen inches;

one or more hinges for: (i) hingably connecting the lengthwise components, (ii) allowing the lengthwise components to hingably move and (iii) controlling or fixing a spatial relationship between the lengthwise components; and a one-piece lever comprising an integral lower section securely connected to the second lengthwise component by a second transverse pin, the one-piece lever operable to move the first component towards the second component to fix in position an edge portion of a backing layer within the first and second lengthwise components and move the first component away from the second component to release the edge portion of the backing layer from within the first and second lengthwise components, wherein the one-piece lever further comprises perimeter edge surfaces configured to slidably contact the first transverse pin as force is applied to the one-piece lever to guide movement of the first lengthwise component with respect to the second lengthwise component.

2. The device as in claim 1 wherein the one or more hinges comprise a single long continuous hinge.

3. The device as in claim 1 wherein the first and second lengthwise components each comprise one or more shaped, relief corner edge surfaces configured proximate to one of the hinges for reducing binding of the backing layer.

4. The device as in claim 3 wherein each of the relief corner edge edge surfaces comprise a diagonal surface.

5. The device as in claim 1 wherein the first and second lengthwise components are composed of an aluminum.

6. The device as in claim 1 further comprising a gripping layer positioned on, or made integral to, inside, outer edges of each the first and second lengthwise components for contacting the edge portion of the backing layer fixed in position between the first and second lengthwise components to further fix in position the edge portion between the components.

7. The device as in claim 6 wherein the gripping layer is composed of a non-skid foam.

8. The device as in claim 7 wherein the non-skid foam comprises a closed cell, ethylene propylene diene monomer material with a high coefficient of friction surface.

9. The device as in claim 1 wherein the weight of the device is 7 ounces or less.

10. The device as in claim 1 wherein the width of the first component is 2 inches and the width of the second lengthwise component is separately 2 inches.

11. The device as in claim 1 wherein the width of the first and second lengthwise components is configured to cover a portion of the backing layer without the need to precisely position the edge portion between the lengthwise components.

12. The device as in claim 1 wherein each of the lengthwise components comprises a substantially flat, lengthwise section and a substantially right angle, bend section for providing rigidity and strength to a respective component and for reducing bowing of a respective component.

13. The device as in claim 1 wherein at least the first and second lengthwise components comprise one or more coatings for reducing the transfer of oxidants to a quilted product.

14. The device as in claim 13 wherein the one or more coatings are selected from a powder, paint, or plating.

15. The device as in claim 13 wherein the one or more coatings for each lengthwise component are integral to a respective lengthwise component.

16. The device as in claim 1 further comprising a bracket connected to substantially a center of the second lengthwise component for distributing forces applied to the device by tensioning means for applying a substantially uniform force along the entire length of the edge portion.

17. The device as in claim 1 further comprising tensioning means for applying a substantially uniform force along the entire length of the edge portion.

18. The device as in claim 17 wherein the tensioning means comprises an elastic portion and a non-elastic portion.

19. The device as in claim 1 wherein the one-piece lever is operable to guide movement of the first lengthwise component with respect to the second lengthwise component to an angle of 60 degrees.

* * * * *